US007614691B1

(12) United States Patent
Schmitz

(10) Patent No.: US 7,614,691 B1
(45) Date of Patent: Nov. 10, 2009

(54) SUPPORT CUSHION

(76) Inventor: Frances L. Schmitz, 824 Webster St., Nokomis, IL (US) 62075

( * ) Notice: Subject to any disclaimer, the term of this patent is extended or adjusted under 35 U.S.C. 154(b) by 0 days.

(21) Appl. No.: 12/325,607

(22) Filed: Dec. 1, 2008

(51) Int. Cl.
*A47C 1/16* (2006.01)

(52) U.S. Cl. ..... 297/219.1; 297/229; 297/230.13; 5/922

(58) Field of Classification Search ..... 5/653, 5/655, 417, 922, 419; 297/219.1, 219.12, 297/228.1, 229, 230.1, 230.13
See application file for complete search history.

(56) References Cited

U.S. PATENT DOCUMENTS 2,652,183 A * 9/1953 Hlivka ..... 297/229
2,734,556 A * 2/1956 Hebrank ..... 297/230.1
4,654,907 A 4/1987 Haugaard
4,824,169 A * 4/1989 Jarrell ..... 297/284.1
5,056,533 A * 10/1991 Solano ..... 5/627
5,265,292 A 11/1993 Underell
D377,574 S 1/1997 Mades
5,702,153 A * 12/1997 Pliska ..... 297/256.16
5,906,413 A * 5/1999 Yang ..... 297/284.5
6,062,930 A 5/2000 Smith
6,652,026 B2 11/2003 Toyota et al.
6,929,325 B1 * 8/2005 Goelo ..... 297/219.1
6,951,367 B1 * 10/2005 Dinnan ..... 297/228.12
D541,366 S 4/2007 Rominger
2002/0021034 A1 2/2002 Morgan et al.

* cited by examiner

*Primary Examiner*—Alexander Grosz
(74) *Attorney, Agent, or Firm*—Crossley Patent Law; Mark A. Crossley

(57) ABSTRACT

A support cushion that is designed to allow an individual to sit in an upright position for a long period of time and also to serve alternatively as a neck pillow if needed. The cushion is designed to be compact and lightweight and to be easily stored when not in use. The support cushion includes a padded seat, a backing attached to the padded seat, and a tube pillow capable of being removably attached to the backing.

1 Claim, 6 Drawing Sheets

SUPPORT CUSHION

BACKGROUND OF THE INVENTION

The present invention concerns that of a new and improved support cushion that is designed to allow an individual to sit in an upright position for a long period of time and also to serve alternatively as a neck pillow if needed.

SUMMARY OF THE INVENTION

The present invention concerns that of a new and improved support cushion that is designed to allow an individual to sit in an upright position for a long period of time and also to serve alternatively as a neck pillow if needed. The cushion is designed to be compact and lightweight and to be easily stored when not in use. The support cushion includes a padded seat, a backing attached to the padded seat, and a tube pillow capable of being removably attached to the backing.

There has thus been outlined, rather broadly, the more important features of a support cushion that the detailed description thereof that follows may be better understood and in order that the present contribution to the art may be better appreciated. There are, of course, additional features of the support cushion that will be described hereinafter and which will form the subject matter of the claims appended hereto.

In this respect, before explaining at least one embodiment of the support cushion in detail, it is to be understood that the support cushion is not limited in its application to the details of construction and to the arrangements of the components set forth in the following description or illustrated in the drawings. The support cushion is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present support cushion. It is important, therefore, that the claims be regarded as including such equivalent constructions insofar as they do not depart from the spirit and scope of the present invention.

It is therefore an object of the present invention to provide a support cushion which has all of the advantages of the prior art and none of the disadvantages.

It is another object of the present invention to provide a support cushion which may be easily and efficiently manufactured and marketed.

It is another object of the present invention to provide a support cushion which is of durable and reliable construction.

It is yet another object of the present invention to provide a support cushion which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
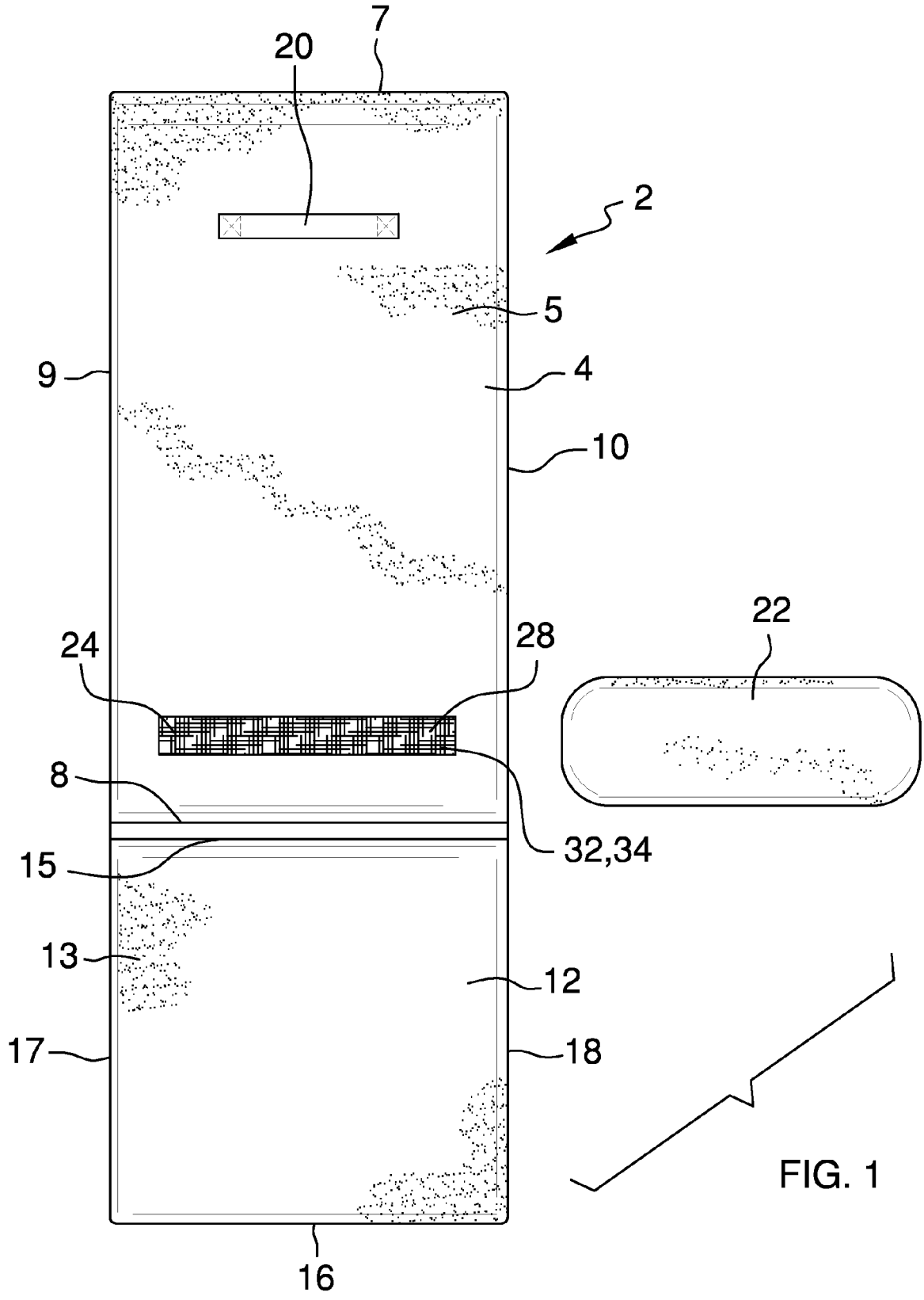
FIG. 1 shows a top view of the support cushion.
Figure 2:
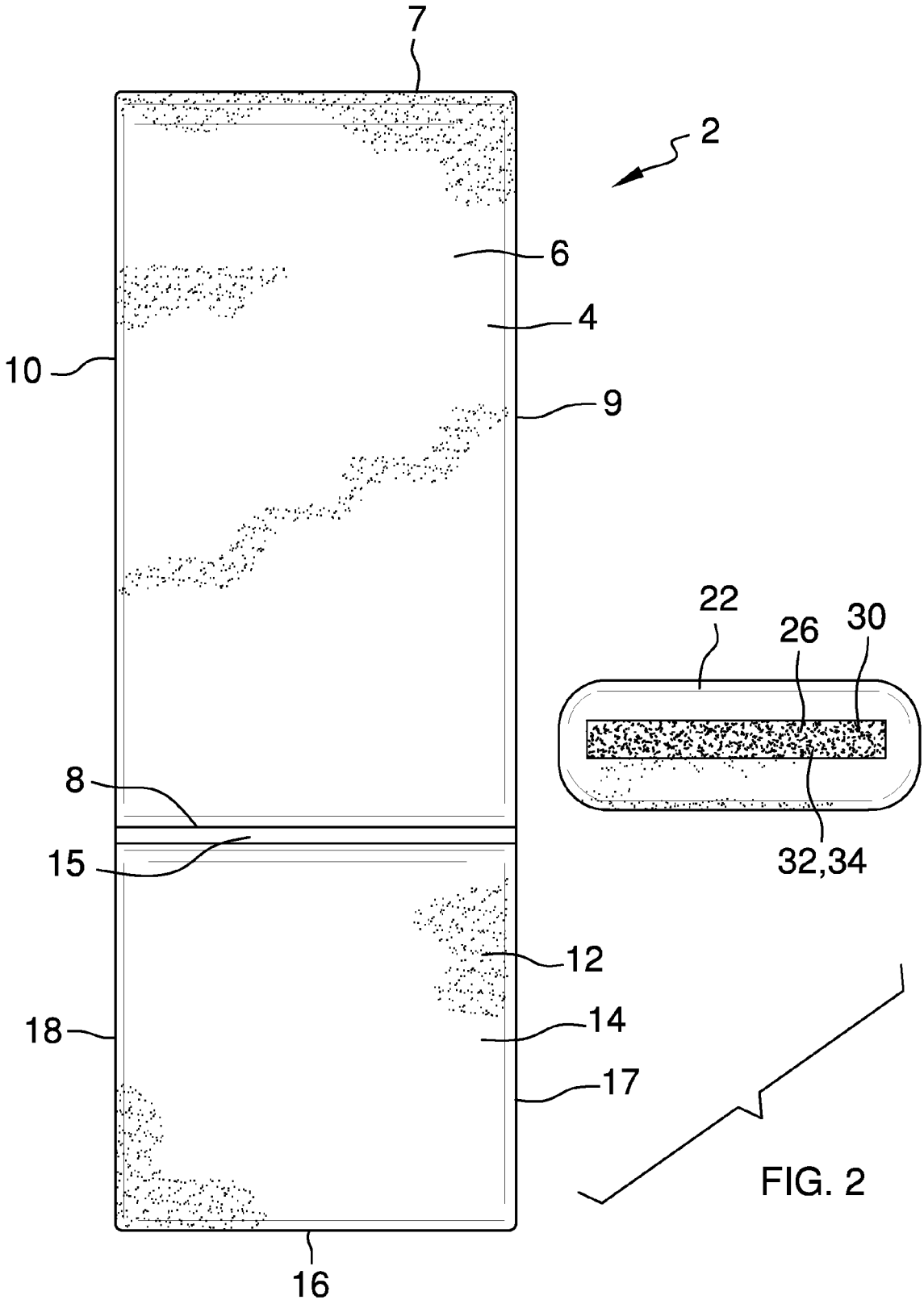
FIG. 2 shows a bottom view of the support cushion.
Figure 3:
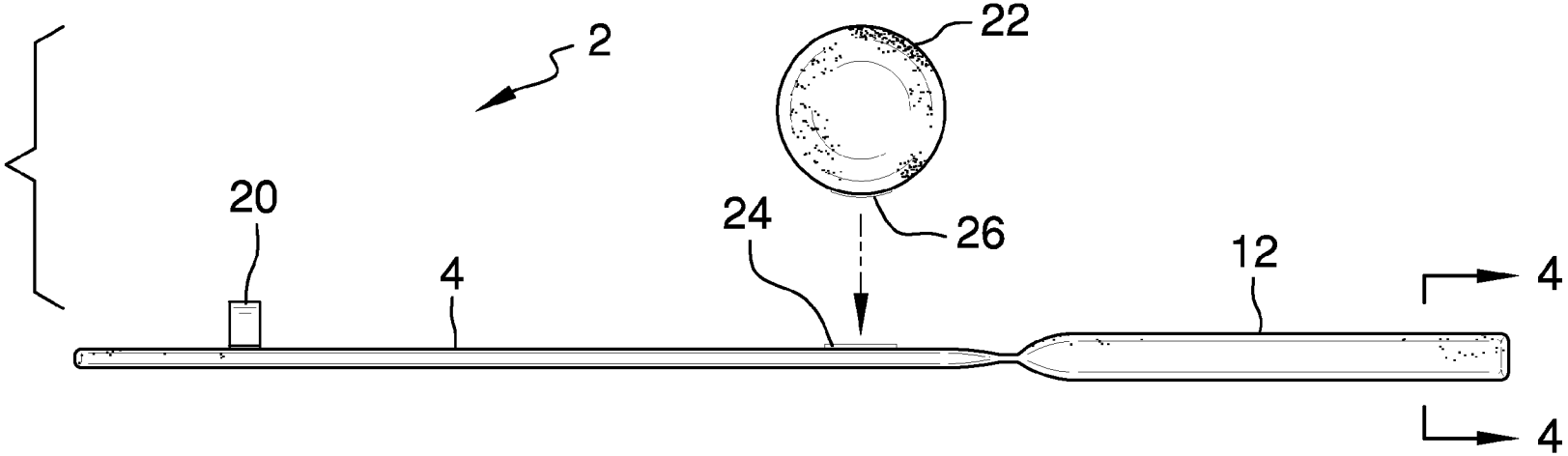
FIG. 3 shows a side view of the support cushion.
Figure 4:
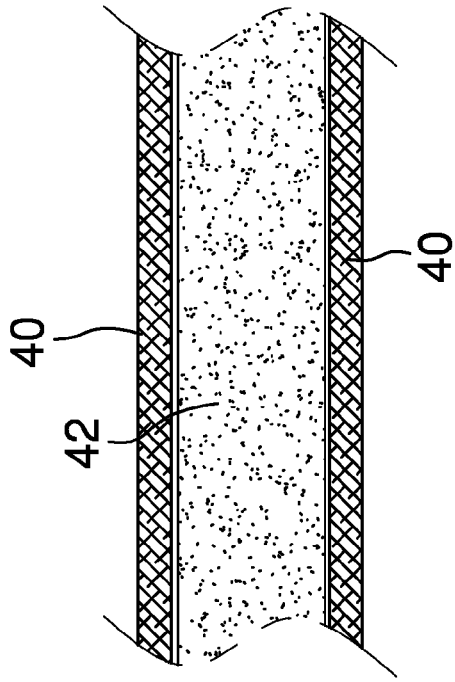
FIG. 4 shows an expanded side view of the backing portion of the support cushion.
Figure 5:
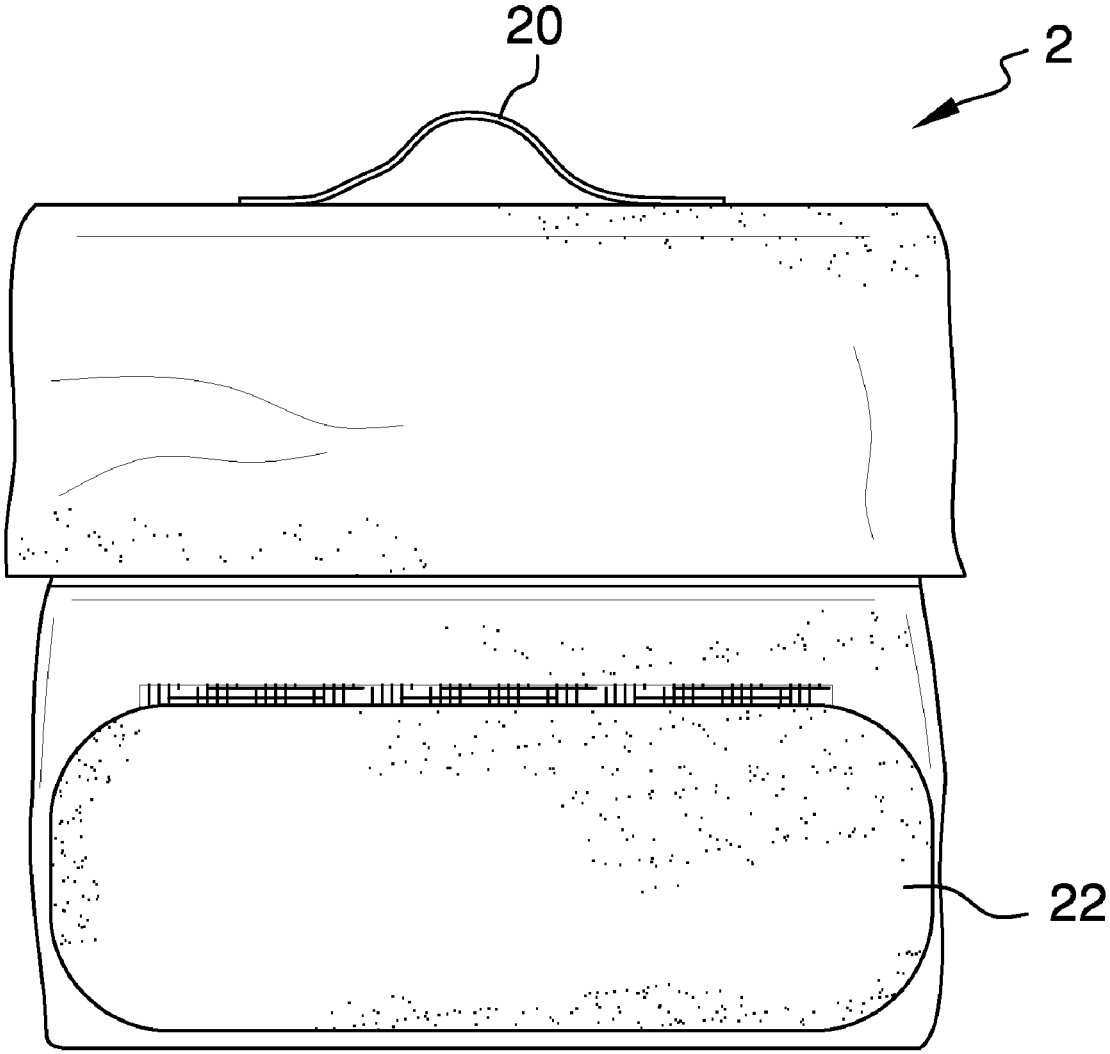
FIG. 5 shows a front view of the support cushion as it appears in a partially collapsed position.

With reference now to the drawings, and in particular to FIGS. 1 through 7 thereof, a support cushion embodying the principles and concepts of the present invention and generally designated by the reference numeral 2 will be described.

As best illustrated in FIGS. 1 through 7, the support cushion 2 comprises a backing 4 that has two surfaces comprising an upper surface 5 and a lower surface 6. The backing 4 also has two ends comprising a first end 7 and a second end 8 and two side edges comprising a first side edge 9 and a second side edge 10.

The support cushion 2 also comprises a padded seat 12 that has two surfaces comprising an upper surface 13 and a lower surface 14. The padded seat 12 also has two ends comprising a first end 15 and a second end 16 and two side edges comprising a first side edge 17 and a second side edge 18. The first end 15 of the support cushion 2 is pivotally attached to the second end 8 of the backing 4. The padded seat 12 has a layer of padding 42 in between two boundary layers 40 that enclose the padding 42.

The support cushion 2 further includes a handle 20 that is located on the upper surface 5 of the backing 4 near the first end 7 of the backing 4. Preferably, the padded seat 12 is thicker than the backing 4 portion.

The support cushion 2 also includes a tube pillow 22 that is attachable to the upper surface 5 of the backing 4 near the second end 8 of the backing 4. A first patch 24 is located on the upper surface 5 of the backing 4 near the second end 8 of the backing 4, with a second patch 26 being located on the tube pillow 22. The first patch 24 has a first plurality of attachment objects 28 on it, while the second patch 26 has a second plurality of attachment objects 30 on it. Between the first plurality of attachment objects 28 and the second plurality of attachment objects 30, one of the pluralities of attachment objects comprises a plurality of hooks 32 and the other plurality of attachment objects comprises a plurality of loops 34. Together, these two patches form a "hook and loop" attachment system.

Figure 6:
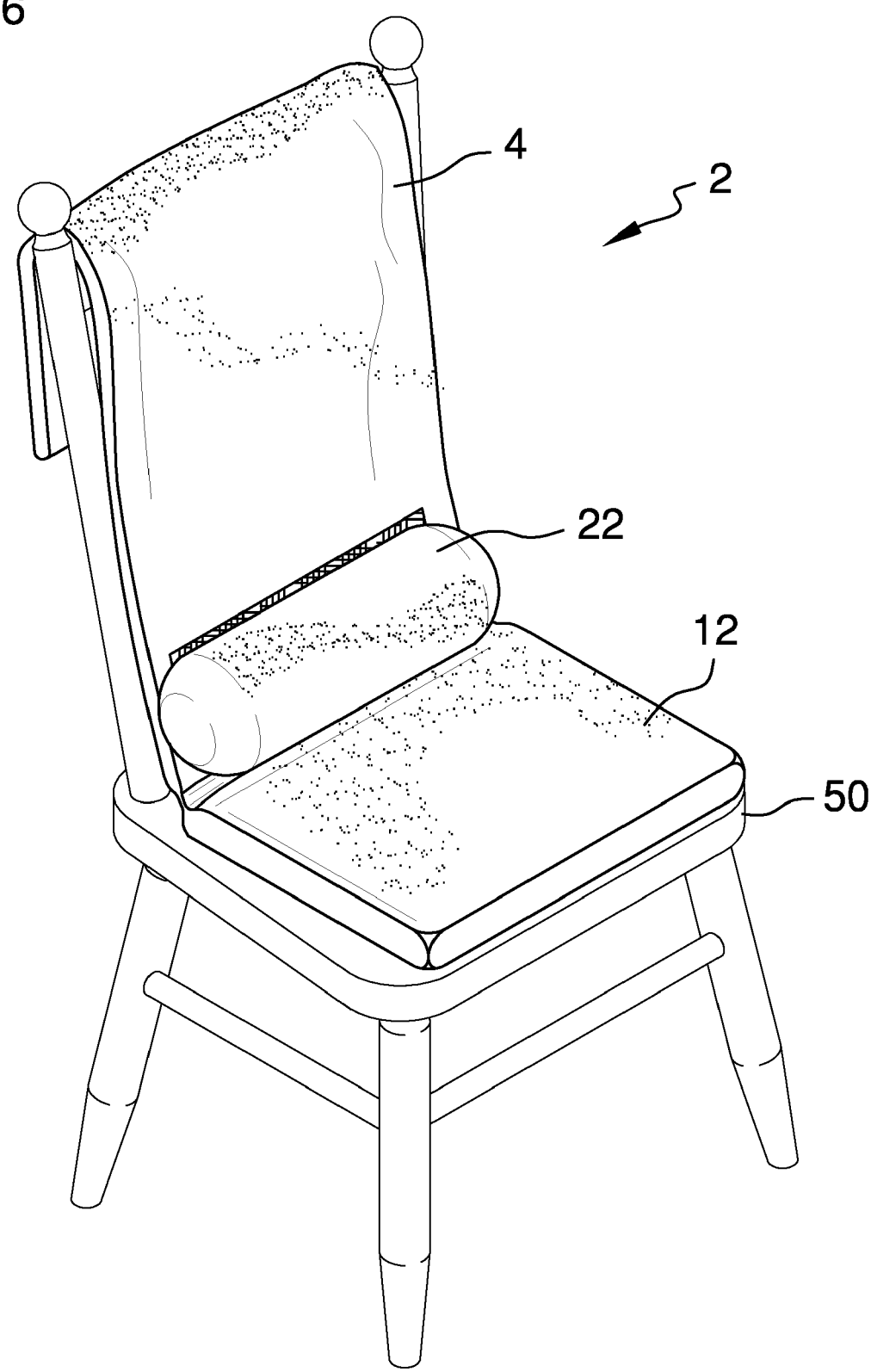
FIG. 6 shows a perspective view of the support cushion as it appears in use attached to a chair.
Figure 7:
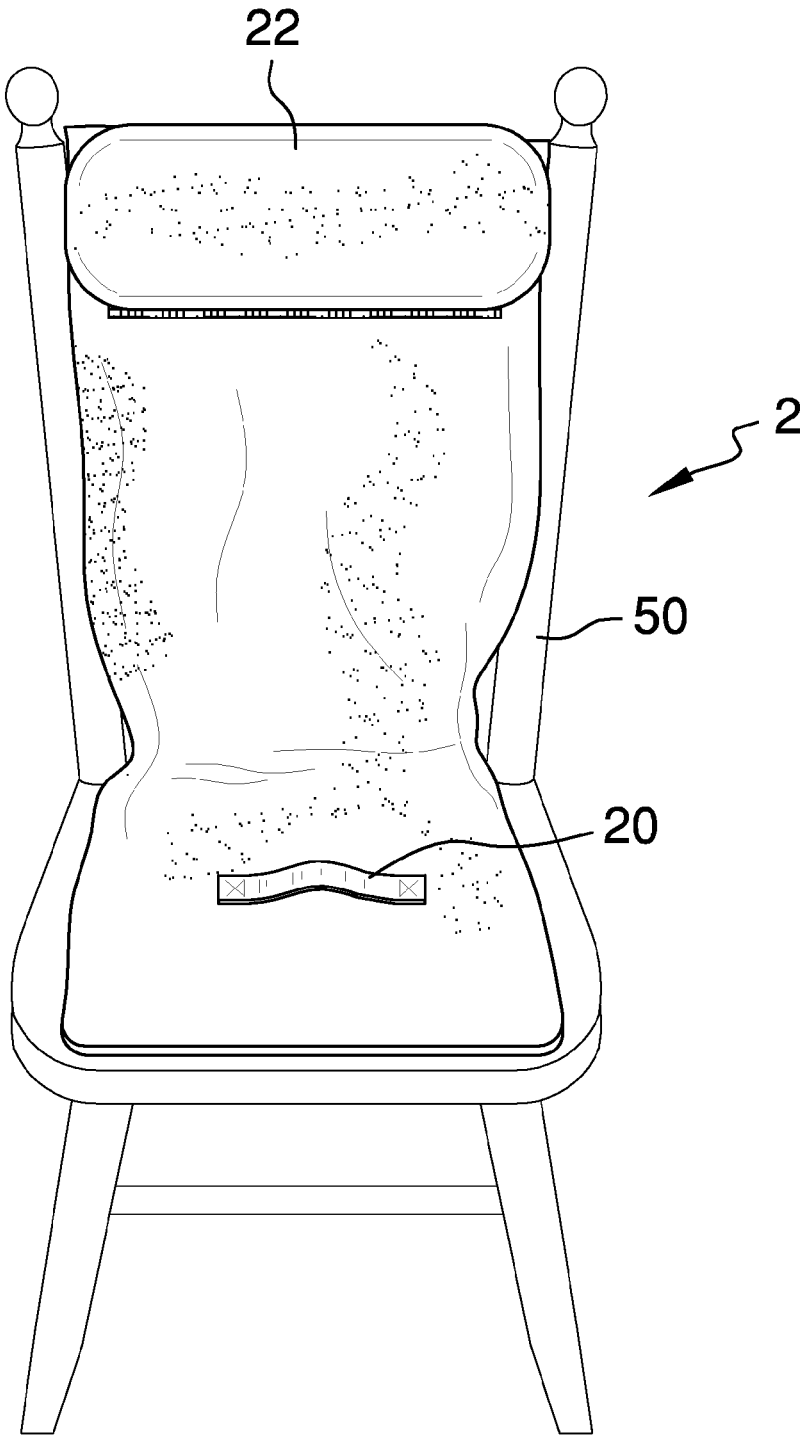
FIG. 7 shows a front view of the support cushion as it appears in use attached to a chair.

In use, the support cushion 2 can be draped over a chair 50 or other object in a number of positions. FIGS. 6 and 7 represent some possibilities of the positions in which the support cushion 2 could be used.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A support cushion comprising (a) a generally rectangular padded seat, the padded seat further comprising two surfaces comprising an upper surface and a lower surface, the padded seat further comprising two ends comprising a first end and a second end, the padded seat further comprising two side edges comprising a first side edge and a second side edge, the padded seat further comprising an amount of padding, the padded seat further comprising a pair of outer layers comprising a first outer layer and a second outer layer, wherein the padding is located in between the first outer layer and the second outer layer, (b) means for providing backing support to the padded seat, said means further comprising (i) a flexible, foldable, generally rectangular backing, the backing further comprising two surfaces comprising an upper surface and a lower surface, the backing further comprising two ends comprising a first end and a second end, the backing further comprising two side edges comprising a first side edge and a second side edge, and (ii) means for transporting the support cushion, said means further comprising (1) a single elongated parallelepiped handle disposed horizontally across the backing upper surface near the first end of the backing, (2) wherein the handle is located on the upper surface of the backing near the first end of the backing, the padded seat being thicker than the backing, and being pivotally connected to the backing, (c) a pillow, wherein the pillow is a tube pillow of a length adapted to extend from the first side edge to the second side edge of the backing, (d) means for removably attaching the pillow to the support cushion, said means further comprising (i) a first patch, wherein the first patch is attached to the upper surface of the backing near the second end of the backing, (ii) a second patch, wherein the second patch is attached to the tube pillow, (iii) means for removably connecting the first patch to the second patch, said means further comprising (1) a first plurality of attachment objects attached to the first patch, (2) a second plurality of attachment objects attached to the second patch, (3) wherein one of the pluralities of attachment objects comprises a plurality of hooks, (4) further wherein one of the pluralities of attachment objects comprises a plurality of loops, (5) wherein a first patch will become removably connected to a second patch once the first patch is placed into contact with the second patch.

* * * * *